US007920809B2

(12) United States Patent
Asada et al.

(10) Patent No.: US 7,920,809 B2
(45) Date of Patent: Apr. 5, 2011

(54) SHEET FEEDING DEVICE, AND IMAGE RECORDING APPARATUS WITH THE SHEET FEEDING DEVICE

(75) Inventors: Tetsuo Asada, Kuwana (JP); Yukio Shiohara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/569,945

(22) Filed: Sep. 30, 2009

(65) Prior Publication Data

US 2010/0078872 A1 Apr. 1, 2010

(30) Foreign Application Priority Data

Sep. 30, 2008 (JP) ..... 2008-254731

(51) Int. Cl.
*G03G 21/00* (2006.01)

(52) U.S. Cl. ..... 399/124; 399/401

(58) Field of Classification Search ..... 399/107, 399/110, 124, 361, 381, 388, 391, 397, 401; 271/65, 186, 246
See application file for complete search history.

(56) References Cited

U.S. PATENT DOCUMENTS

| | | | | |
|---|---|---|---|---|
| 4,436,404 | A * | 3/1984 | Simmons et al. | 399/401 |
| 5,950,050 | A | 9/1999 | Shirasaki et al. | |
| 6,650,862 | B2 * | 11/2003 | Nakano et al. | 399/323 |
| 2006/0076729 | A1 | 4/2006 | Kozaki et al. | |

FOREIGN PATENT DOCUMENTS

| | | | |
|---|---|---|---|
| JP | S63-212663 | A | 9/1988 |
| JP | H02-123066 | A | 5/1990 |
| JP | H07-215536 | A | 8/1995 |
| JP | H07-251974 | A | 10/1995 |
| JP | 2002-062698 | A | 2/2002 |
| JP | 2006-064727 | A | 3/2006 |

OTHER PUBLICATIONS

Japan Patent Office; Notice of Reasons for Rejection in Japanese Patent Application No. 2008-254731 (counterpart to the above-captioned US Patent Application) mailed on Sep. 1, 2010.

* cited by examiner

*Primary Examiner* — Hoan Tran
(74) *Attorney, Agent, or Firm* — Baker Botts L.L.P.

(57) ABSTRACT

A sheet feeding device includes an inner guide member and an outer guide member that define a sheet feeding path therebetween. The sheet feeding device also includes an engaging member positioned adjacent to one of the inner guide member and the outer guide member, and a receiving portion positioned at the other one of the inner guide member and the outer guide member. The engaging member moves between an engaged position to engage the receiving portion and a disengaged position to disengage from the receiving portion. The inner guide member is selectively connected to the outer guide member via the engaging member and the receiving portion. When the engaging member contacts the sheet in the sheet feeding path, the engaging member is in the disengaged position, and when the engaging member is separated from the sheet in the sheet feeding path, the engaging member is in the engaged position.

15 Claims, 8 Drawing Sheets

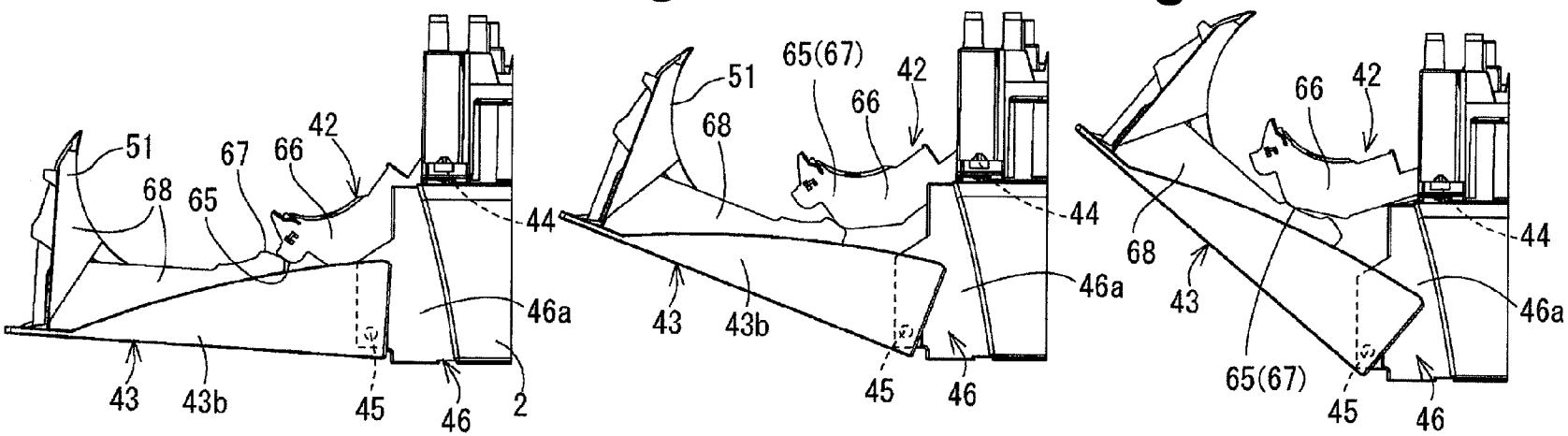
Fig. 9A
Fig. 9B
Fig. 9C
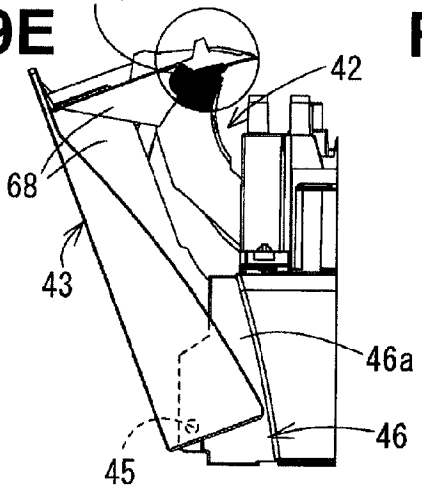
Fig. 9E
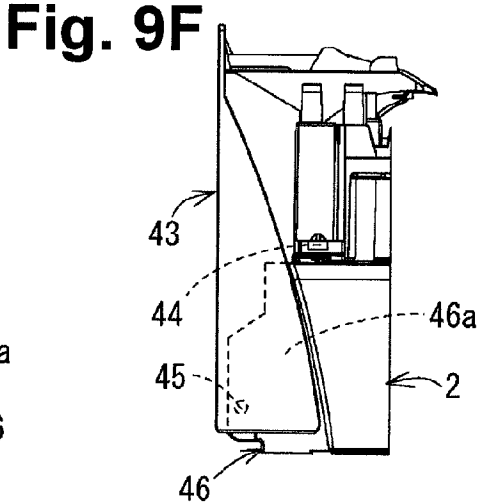
Fig. 9F
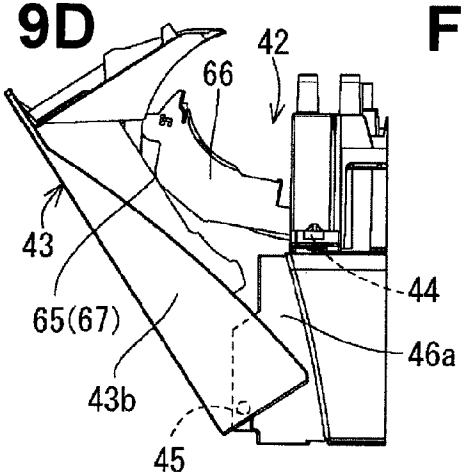
Fig. 9D

SHEET FEEDING DEVICE, AND IMAGE RECORDING APPARATUS WITH THE SHEET FEEDING DEVICE

CROSS REFERENCE TO RELATED APPLICATION

The present application claims priority from Japanese Patent Application No. 2008-254731, which was filed on Sep. 30, 2008, the disclosure of which is incorporated herein by reference in its entirety.

BACKGROUND OF THE INVENTION

1. Field of the Invention

The present invention relates generally to sheet feeding devices and image recording apparatuses with sheet feeding devices comprising a plurality of sheet cassettes, and more particularly to the image recording apparatuses configured to readily clear sheet jams that may occur when sheets are fed from the sheet cassettes.

2. Description of Related Art

A known image recording apparatus, e.g., a copier and a printer, includes an upper sheet cassette and a lower sheet cassette that are independently inserted into or removed from a housing of the apparatus. The known image recording apparatus includes a recording unit positioned above the upper sheet cassette. A U-shaped sheet path is positioned on a rear side of the known apparatus with respect to a cassette insertion and removal direction. Another known image recording apparatus, e.g., the image recording apparatus described in Japanese Laid-Open Patent Publication No. 2006-103954 or corresponding U.S. Pat. No. 7,553,012 B2, includes a feeding device positioned in a housing of the apparatus.

The known image recording apparatus includes a first U-shaped sheet path for feeding a sheet fed from the upper sheet cassette upward while turning the sheet upside down and a second U-shaped sheet path for feeding a sheet fed from the lower sheet cassette upward while turning the sheet upside down. The first and second sheet paths merge into one sheet path leading toward a registration rollers.

The second sheet path is positioned outside of a curvature of the first sheet path. The second sheet path is defined between an inner surface of a second guide member, which is positioned on a rear portion of the housing, and an outer surface of a first guide member. The first guide member and the second guide member are connected to each other to form a guide unit. The guide unit is detachably attached to the rear portion of the housing. The first sheet path is defined between an inner surface of the first guide member and an outer surface of a third guide member. The third guide member is fixed to a main frame of the housing.

The guide unit is removed from the rear portion to clear sheet jams occurred in the first or second sheet path. The first and the second feed guide members are connected to each other, so that it is sometimes difficult to clear sheet jams occurred in the second sheet path. Especially, in a state in which the leading end of a sheet passing through the second sheet path is held between the registration rollers and the trailing end of the sheet is pressed against the pickup roller, a portion of the sheet positioned in a curved portion of the second sheet path may be damaged when the guide unit is removed from the rear portion. Thus, sheet jams cannot be readily cleared.

Another known image recording apparatus, e.g., the image recording apparatus described in Japanese Laid-Open Patent Publication No. 11-272144, includes an image forming unit positioned in a middle portion of a housing with respect to a vertical direction. The another known image forming unit includes a photosensitive member, a toner transfer portion, and a thermal fixing portion. Two sheet cassettes are arranged in a vertical direction below the image forming unit. The another known image recording apparatus includes a U-shaped second sheet path through which a sheet output from the thermal fixing portion is fed toward an output tray positioned on an upper portion of the housing, and a first sheet path configured to feed a sheet in a direction to opposite to the second sheet path. A path switching mechanism including two switching members is positioned at a branching point of the first and second sheet paths.

An output opening and output rollers are positioned at an end of the second sheet path. When a sheet is fed toward the output opening and its trailing end reaches between the output opening and one of the switching members, the output rollers are reversely rotated to change states or positions of the switching members. The sheet having a recorded image on its surface is reversely fed toward the first sheet path and passes through the image forming unit again. The image forming unit forms an image on an opposite, e.g., rear, side of the sheet. The double-sided recorded sheet is output to the output tray through the second sheet path.

A second cover defining the second sheet path is positioned higher than a first cover defining the first sheet path. The image recording apparatus includes an operative mechanism configured to open the first cover in association with an operation of opening the second cover. The first and second covers both need to be open to clear a sheet jam because it is difficult to judge whether a sheet jam occurs in the first or the second sheet path.

Further, in the structure in which the first and the second sheet paths are formed almost at the same height, if the first and second guide members are configured to pivot about a lower end of each first and second guide member and if sheet jams occur in the second sheet path, the sheet is damaged while clearing the sheet jam, because when the first and second guide members are both open at the same time, the sheet in the second sheet path is pressed by the first guide member. To prevent damage to the sheet, the first and second guide members need to be separately open, which is inconvenient and time-consuming. Further, after clearing the sheet jam, the guide members need to be separately returned to their original positions.

SUMMARY OF THE INVENTION

Therefore, a need has arisen for image recording apparatuses which overcome these and other shortcomings of the related art. A technical advantage of the invention is that a sheet path is exposed without damaging jammed sheets, and guide members are readily returned to their original positions.

According to an embodiment of the present invention, a sheet feeding device comprising an inner guide member comprising an inner guide portion, and an outer guide member comprising an outer guide portion, wherein the outer guide portion and the inner guide portion define a sheet feeding path therebetween, and the sheet feeding path is configured to receive a sheet. The sheet feeding device further comprises an engaging member positioned adjacent to one of the inner guide member and the outer guide member, and a receiving portion positioned at the other one of the inner guide member and the outer guide member and positioned to face the engaging member, wherein the receiving portion is configured to selectively engage the engaging member. The engaging member is configured to move between an engaged position in which the engaging member is engaged with the receiving portion and a disengaged position in which the engaging member is disengaged from the receiving portion, and when the engaging member is at the engaged position, the inner guide member is connected to the outer guide member via the engaging member and the receiving portion. When the engaging member contacts the sheet in the sheet feeding path, the engaging member is in the disengaged position, and when the engaging member is separated from the sheet in the sheet feeding path, the engaging member is in the engaged position.

According to another embodiment of the invention, an image recording apparatus comprising a sheet feeding device, a particular sheet stack portion configured to receive a sheet; and a recording unit configured to record an image on the sheet. The sheet feeding device comprises an inner guide member comprising a particular inner guide portion, and an outer guide member comprising an outer guide portion, wherein the outer guide portion and the particular inner guide portion define a particular sheet feeding path therebetween, the particular sheet feeding path is configured to receive the sheet. The sheet feeding device further comprises an engaging member positioned adjacent to one of the inner guide member and the outer guide member, and a receiving portion positioned at the other one of the inner guide member and the outer guide member and positioned to face the engaging member, wherein the receiving portion is configured to selectively engage the engaging member. The engaging member is configured to move between an engaged position in which the engaging member is engaged with the receiving portion and a disengaged position in which the engaging member is disengaged from the receiving portion, and when the engaging member is at the engaged position, the inner guide member is connected to the outer guide member via the engaging member and the receiving portion. When the engaging member contacts the sheet in the particular sheet feeding path, the engaging member is in the disengaged position, and when the engaging member is separated from the sheet in the particular sheet feeding path, the engaging member is in the engaged position.

Other objects, features, and advantages of embodiments of the present invention will be apparent to persons of ordinary skill in the art from the following description of preferred embodiments with reference to the accompanying drawings.

BRIEF DESCRIPTION OF THE DRAWINGS

For a more complete understanding of the present invention, the needs satisfied thereby, and the objects, features, and advantages thereof, reference now is made to the following description taken in connection with the accompanying drawings.

FIG. 9A is a side view of the second and third guide members in pivotally open positions.

FIG. 9B is a side view of the second and third guide members of FIG. 9A during a closing operation.

FIG. 9C is another side view of the second and third guide members of FIG. 9A during the closing operation.

FIG. 9D is another side view of the second and third guide members of FIG. 9A during the closing operation.

FIG. 9E is another side view of the second and third guide members of FIG. 9A during the closing operation.

FIG. 9F is a side view of the second and third guide members in pivotally closed positions.

DETAILED DESCRIPTION OF EMBODIMENTS OF THE INVENTION

Figure 1:
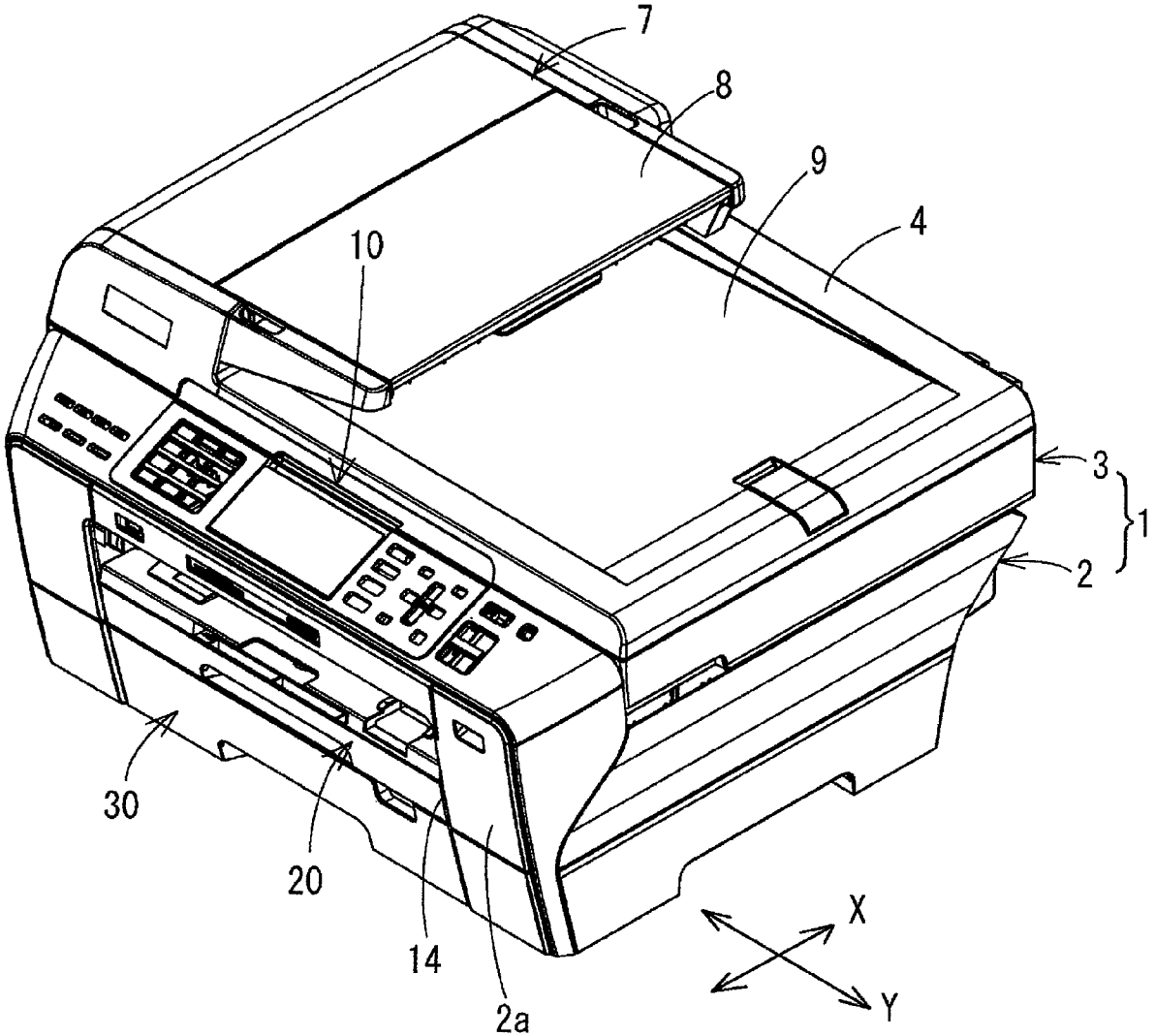
FIG. 1 is a perspective front view of an image recording apparatus according to an embodiment of the invention.

An embodiment of the present invention and its features and technical advantages may be understood by referring to FIGS. 1-9F, like reference numerals being used for like corresponding portions in the various drawings.

According to an embodiment invention, an image recording apparatus, e.g., a multi-function device (MFD) 1, may perform one or more of a printing function, a scanner function, a copying function, and a facsimile function.

Figure 2:
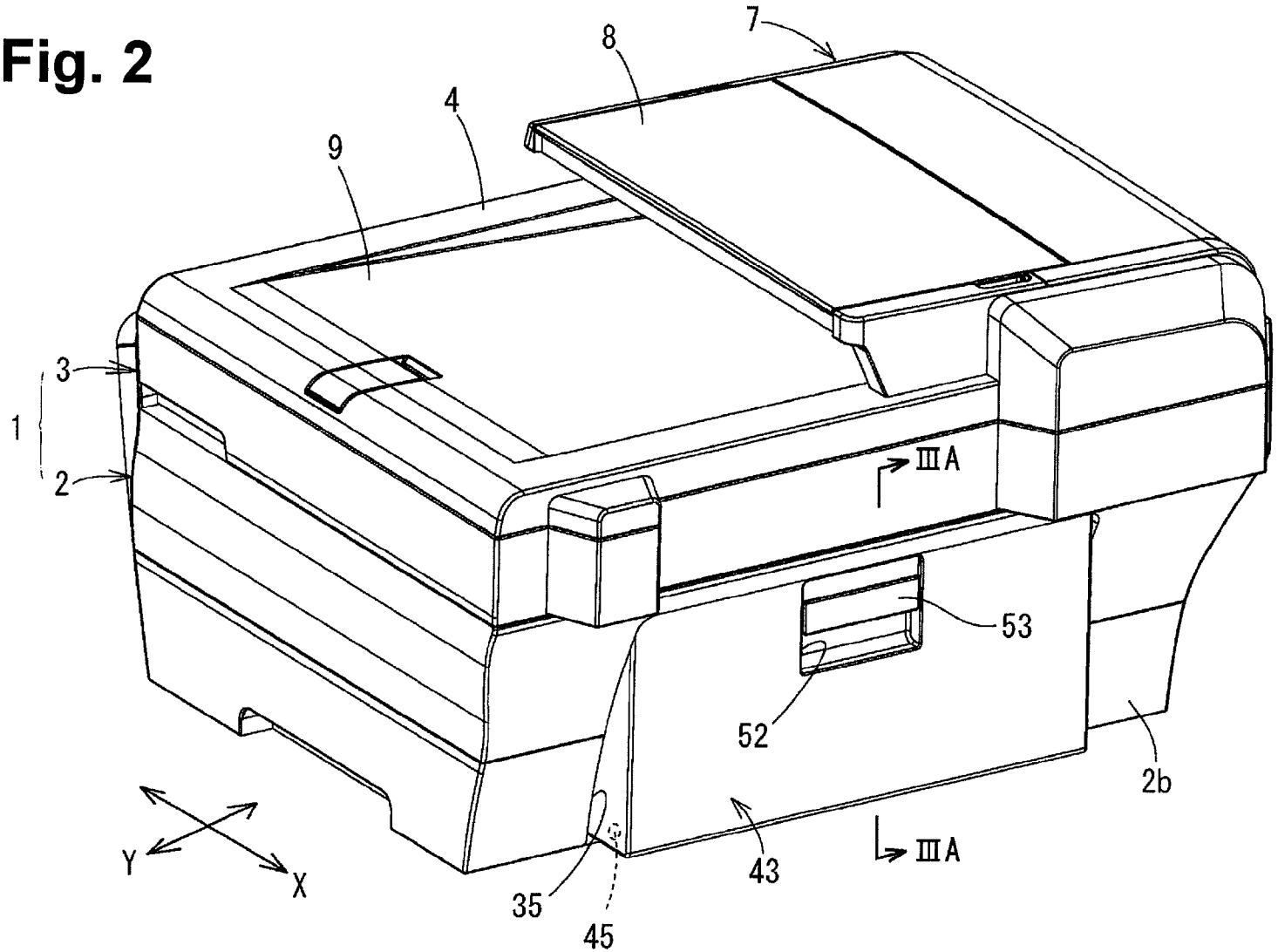
FIG. 2 is a perspective rear view of the image recording apparatus in FIG. 1.
Figure 3A:
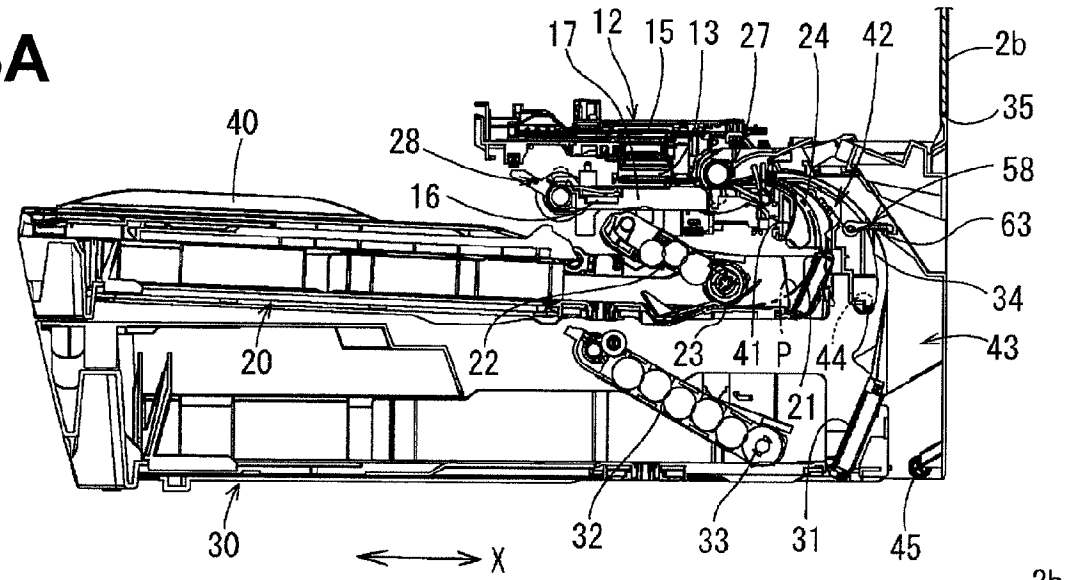
FIG. 3A is a cross-sectional view along line IIIA-IIIA of FIG. 2 illustrating a sheet feeding operation from an upper sheet cassette.

Referring to FIG. 1, MFD 1 may comprise a housing 2, which may comprise synthetic resin. A front side plate 2*a* of housing 2 may have a front opening 14. An upper sheet cassette 20, e.g., a second sheet stack portion, and a lower sheet cassette 30, e.g., a first sheet stack portion, may be removably inserted in a horizontal direction through front opening 14 into housing 2 below a recording unit 12, as shown in FIG. 3A. Referring to FIG. 2, a rear side plate 2*b* of housing 2 opposite to front opening 14 may have a rear opening 35, which may be covered by a third guide member 43. A side of MFD 1 where the front opening 14 is positioned may be a front side, and rear, left, and right sides of MFD 1 are defined with reference to the front side. An X direction may be the front-rear direction of MFD 1 and a Y direction may be the right-left direction of MFD 1.

MFD 1 may comprise an image reading unit 3 configured to read an image on a document, e.g., a copying or facsimile function. Image reading unit 3 may be positioned at an upper portion of housing 2. Image reading unit 3 may read a document and produce image data, e.g., photo data or text data. In a copying operation, MFD 1 may record the image data, e.g., photo or text, produced by image reading unit 3 on a recording medium, e.g., a sheet. In a facsimile operation, MFD 1 may send the image data produced by image reading unit 3 to an external communication device, e.g., other facsimile machines, via communication networks, e.g., telephonic networks. MFD 1 may send the image data produced by image reading unit 3 to a computer, which may be connected to MFD 1 via a cable.

Image reading unit 3 may comprise a flatbed scanner. MFD 1 may comprise a document reading glass and an image sensor positioned below a pivotal document cover 4. Document cover 4 may be a top panel of MFD 1. In an embodiment, the image sensor may comprise a contact image sensor (CIS) elongated in the X direction. In another embodiment, the image sensor may comprise a charge coupled device (CCD). A document to be read by the image sensor may be placed on the document reading glass. The image sensor may reciprocate in the Y direction below the document reading glass to read an image of the document placed on the document reading glass.

Document cover 4 may comprise an auto-document feeder (ADF) 7 configured to feed documents automatically. ADF 7 may feed documents placed on a document tray 8 to the document reading glass one at a time. Document tray 8 may be folded over, as shown in FIG. 1. The image sensor may read the documents fed by ADF 7 through the document reading glass. The image sensor may remain below the document reading glass. The read documents may be output to an output tray 9.

MFD 1 may comprise a control panel 10 at an upper front portion of MFD 1. Control panel 10 may comprise operational buttons and a liquid crystal display, as shown in FIG. 1.

Referring to FIG. 3A, an upper portion of housing 2 may comprise a recording unit 12. Recording unit 12 may comprise a carriage 15 and a recording head 13, e.g., an inkjet head, mounting on carriage 15. Ink cartridges containing color ink may be accommodated inside housing 2. Ink stored in the ink cartridges may be independently supplied to recording head 13, via flexible ink supply tubes.

Carriage 15 may be configured to reciprocate in the Y direction along a pair of guide rail plates (not shown) disposed in a main frame 16. Ink may be selectively ejected from recording head 13 according to image data when carriage 15 reciprocates. An image may be recorded on a recording medium, e.g., sheet P or P1, placed on a platen 17, which is attached to main frame 16.

Upper sheet cassette 20 and lower sheet cassette 30 may hold a stack of sheets P and a stack of sheets P1, respectively. Sheet cassettes 20 and 30 may be inserted into MFD 1 in a sheet feeding direction of sheets P and P1 through front opening 14. Sheet cassettes 20 and 30 may be removed from MFD 1 through front opening 14, in a direction opposite to the sheet feeding direction. Lower sheet cassette 30 may be a large-capacity-type cassette configured to hold a larger number of sheets P1 than upper sheet cassette 20 does. Upper sheet cassette 20 may be thinner than lower sheet cassette 30. Sheet cassettes 20 and 30 may hold different sizes of sheets P and P1, respectively.

An upper separation plate 21 may be positioned on a rear side of upper sheet cassette 20, e.g., right side in FIG. 3A. An upper pickup roller 23 may be pivotally supported by an end of an upper pickup arm 22. Upper pickup roller 23 may be positioned adjacent to a rear portion of a bottom surface of upper sheet cassette 20. Upper pickup arm 22 may be urged downward such that pickup roller 23 may contact an uppermost sheet of a stack of sheets P stored in sheet cassette 20. A drive source (not shown) may transmit a drive force to rotate pickup roller 23, which may feed the uppermost sheet P to an upper sheet path 24, e.g., a second sheet feeding path.

Upper sheet path 24 may form a "U" shape. Upper sheet path 24 may extend upward from separation plate 21 and make a U-turn toward a front side of MFD 1. After an image is recorded on sheet P, sheet P may be output to an output tray 40, which may be positioned on an upper side of upper sheet cassette 20. Arm 22 may be configured to selectively move up and down when upper sheet cassette 20 is being inserted into or removed from MFD 1.

Figure 3B:
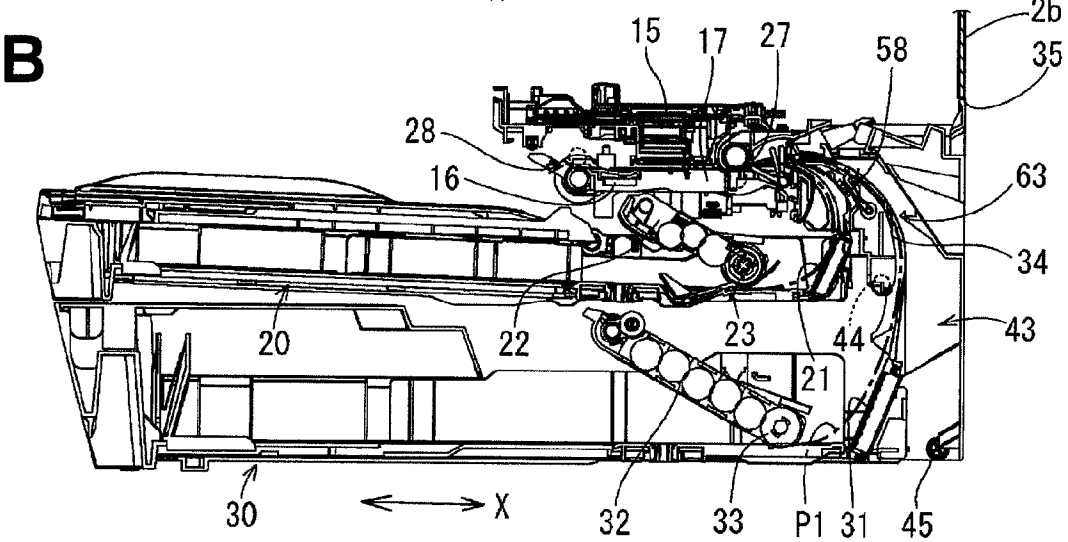
FIG. 3B is a cross-sectional view along line IIIA-IIIA of FIG. 2 illustrating a sheet feeding operation from a lower sheet cassette.

A lower separation plate 31 may be positioned on a rear side of lower sheet cassette 30, e.g., right side in FIG. 3B. A lower pickup roller 33 may be pivotally supported by an end of a lower pickup arm 32. Lower pickup roller 33 may be positioned adjacent to a rear portion of a bottom surface of lower sheet cassette 30. Arm 32 may be urged downward such that pickup roller 33 may contact an uppermost sheet of a stack of sheets P1 stored in sheet cassette 30. Separation plate 31, pickup arm 32 and pickup roller 33 may function as a feeding device. A drive force (not shown) may transmit a drive force to rotate pickup roller 33 to feed the uppermost sheet of sheets P1 to a lower sheet path 34, e.g., a first sheet feeding path.

Lower sheet path 34 may be positioned outside the radius of curvature of upper sheet path 24. Lower sheet path 34 may extend upward from separation plate 31 and make a U-turn toward a front side of MFD 1. Upper and lower sheet paths 24 and 34 may merge at an upstream of recording unit 12 in the sheet feeding direction. Sheet P1 may pass through lower sheet path 34. Recording unit 12 may record an image on sheet P1. Then, sheet P1 may be output to output tray 40. Arm 32 may be configured to selectively move up and down when lower sheet cassette 30 is being inserted into or removed from MFD 1. A user may retrieve sheet P and P1 from output tray 40 through front opening 14.

Lower sheet cassette 30 may be removably inserted into housing 2. In an embodiment, cassettes 20 and 30 may be configured to move forward and rearward in housing 2 with at least a portion of the cassettes 20 and 30 still attached to housing 2.

Upper sheet path 24 may be defined by an outer surface of a first guide member 41, which may be positioned inwardly of rear opening 35, and an inner surface of a second guide member 42, e.g., an inner guide member, which may be positioned outwardly of first guide member 41. First guide member 41 may be attached to main frame 16.

A pair of registration rollers 27 may be positioned between a merge point of sheet paths 24 and 34 and an upstream portion of recording unit 12 in the sheet feeding direction. Registration rollers 27 may intermittently feed sheets P and P1 and reduce the skew of sheets P and P1. the registration roller 27 positioned on a lower side may be a driven roller and the registration roller 27 positioned on the upper side may be a drive roller.

Referring to FIGS. 3A and 3B, a pair of output rollers 28 may be positioned downstream of registration rollers 27 in the sheet feeding direction across recording unit 12 from registration rollers 27. Output rollers 28 may feed recorded sheets P and P1 onto output tray 40. Output rollers 28 may comprise a spur roller, which may contact an upper side, e.g., a recorded side, of sheets P and P1, and an output roller, which may contact a lower side, e.g., a non-recorded side, of sheets P and P1.

Lower sheet path 34 may be defined by an outer surface of second guide member 42 and an inner surface of a third guide member 43, which may be positioned outwardly of second guide member 42. As shown in FIGS. 3A and 3B, second and third guide members 42 and 43 may pivot about shafts 44 and 45, respectively, to selectively cover and expose rear opening 35.

Figure 4A:
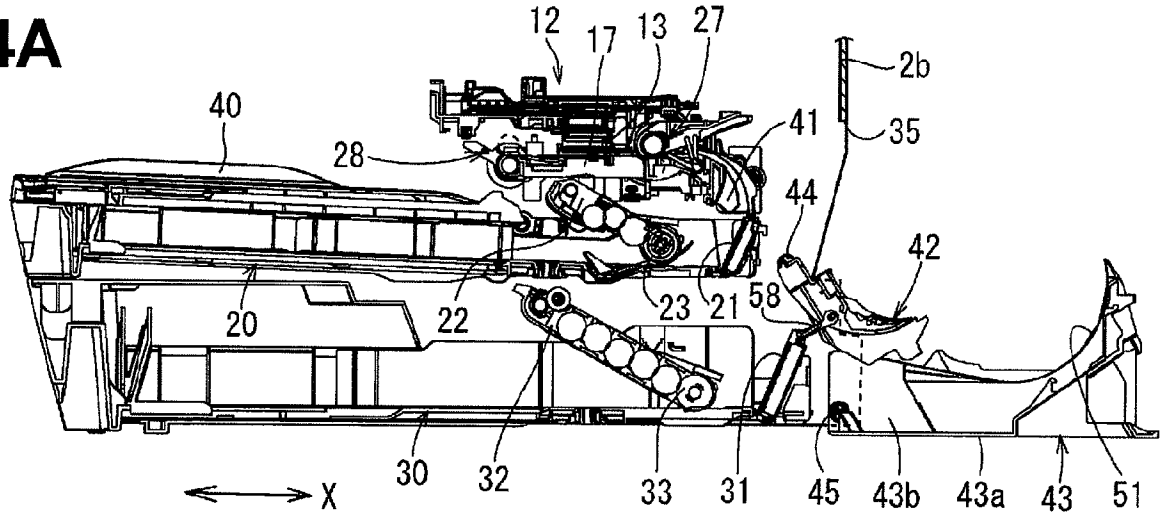
FIG. 4A is a cross-sectional view along line IIIA-IIIA of FIG. 2 with a second guide member and a third guide member in open positions.
Figure 4B:
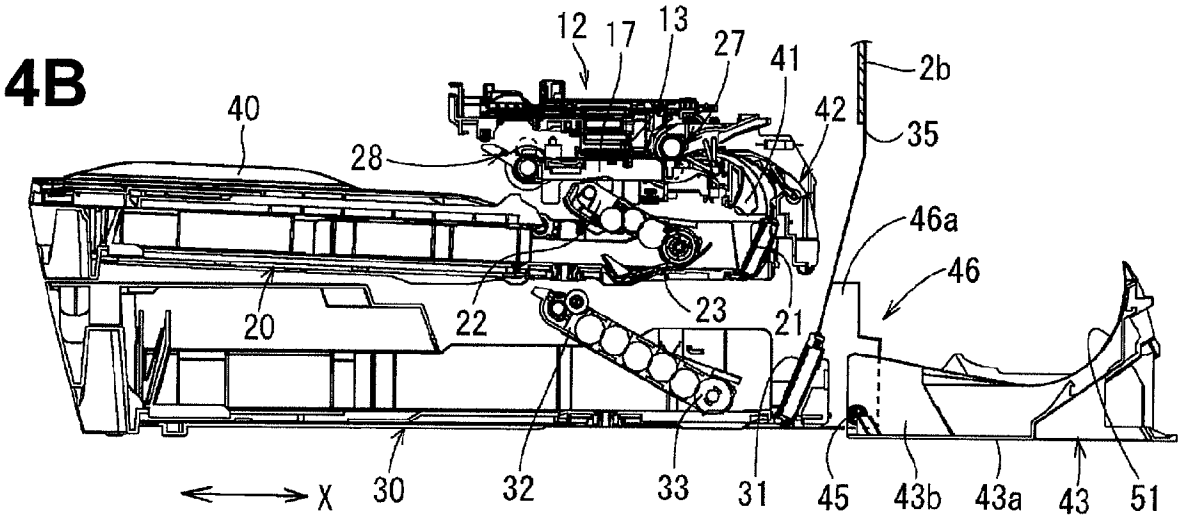
FIG. 4B is a cross-sectional view along line IIIA-IIIA of FIG. 2 with the third guide member in the open position.

As shown in FIG. 4B, a frame member 46 may be positioned adjacent to shaft 45 of third guide member 43. Frame member 46 may comprise a flange plate portion 46*a*. Frame member 46 may extend rearward from each of the right and left sides of rear side plate 2*b* along the right and left edges of rear opening 35, respectively. A fin portion 43*b* may be formed on each of the right and left side of rear plate 43*a* of third guide member 43. An inner surface of fin portions 43*b* of third guide member 43 may face an outer surface of respective flange plate portions 46*a* of frame member 46. Shaft 45 may extend from each fin portion 43*b*. Shafts 45 may rotatably be supported by bearings (not shown) positioned at flange plate portion 46*a*.

Figure 5A:
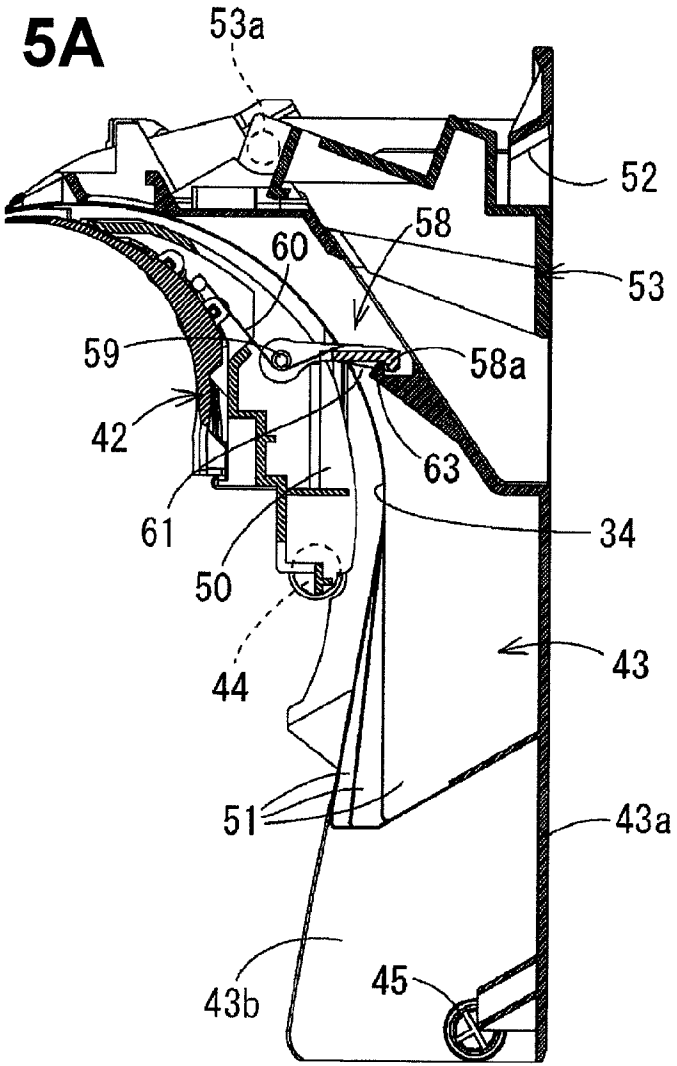
FIG. 5A is a cross-sectional view of the second and third guide members in FIGS. 4A-B connected to each other by a hook member.
Figure 5B:
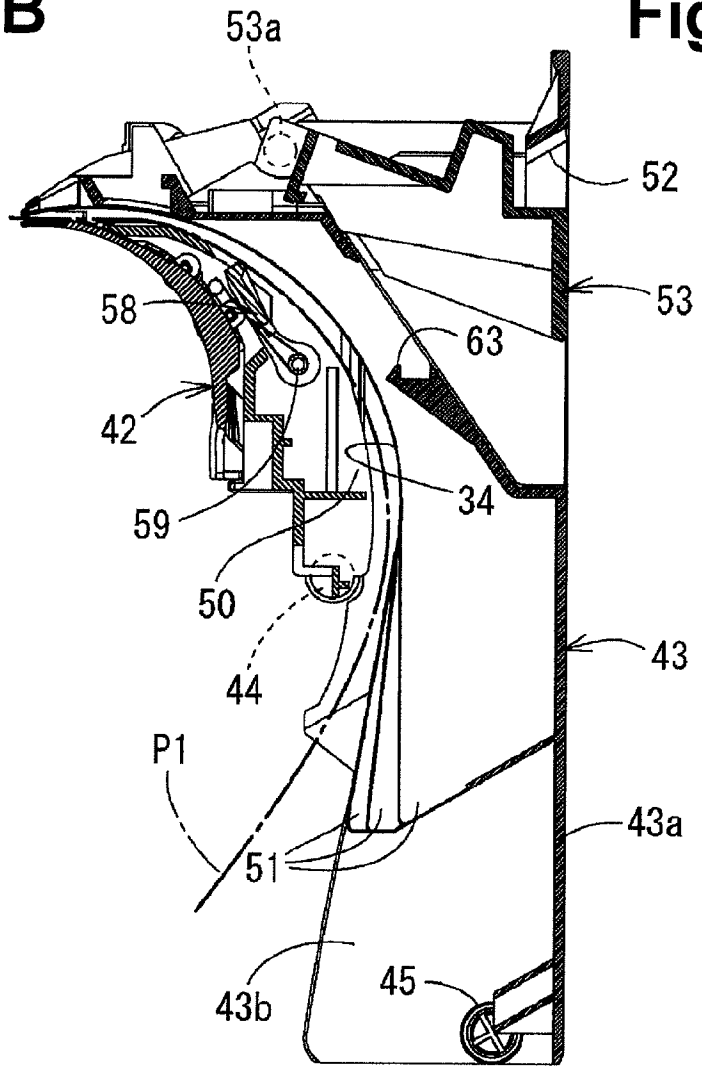
FIG. 5B is a cross-sectional view of the second and third guide members of FIGS. 4A-B separated from each other.

Ribs 50 and 51 may be integrally formed on an outer surface of second guide member 42 and an inner surface of third guide member 43, respectively. Ribs 50 and 51 may be formed at some distance therebetween along a width, e.g., lateral, direction of sheet P, e.g., Y direction. As shown in FIGS. 5A and 5B, outer edges of ribs 50 and inner edges of ribs 51 may form a curved portion of lower sheet path 34 when viewed from a side along Y direction.

Figure 8:
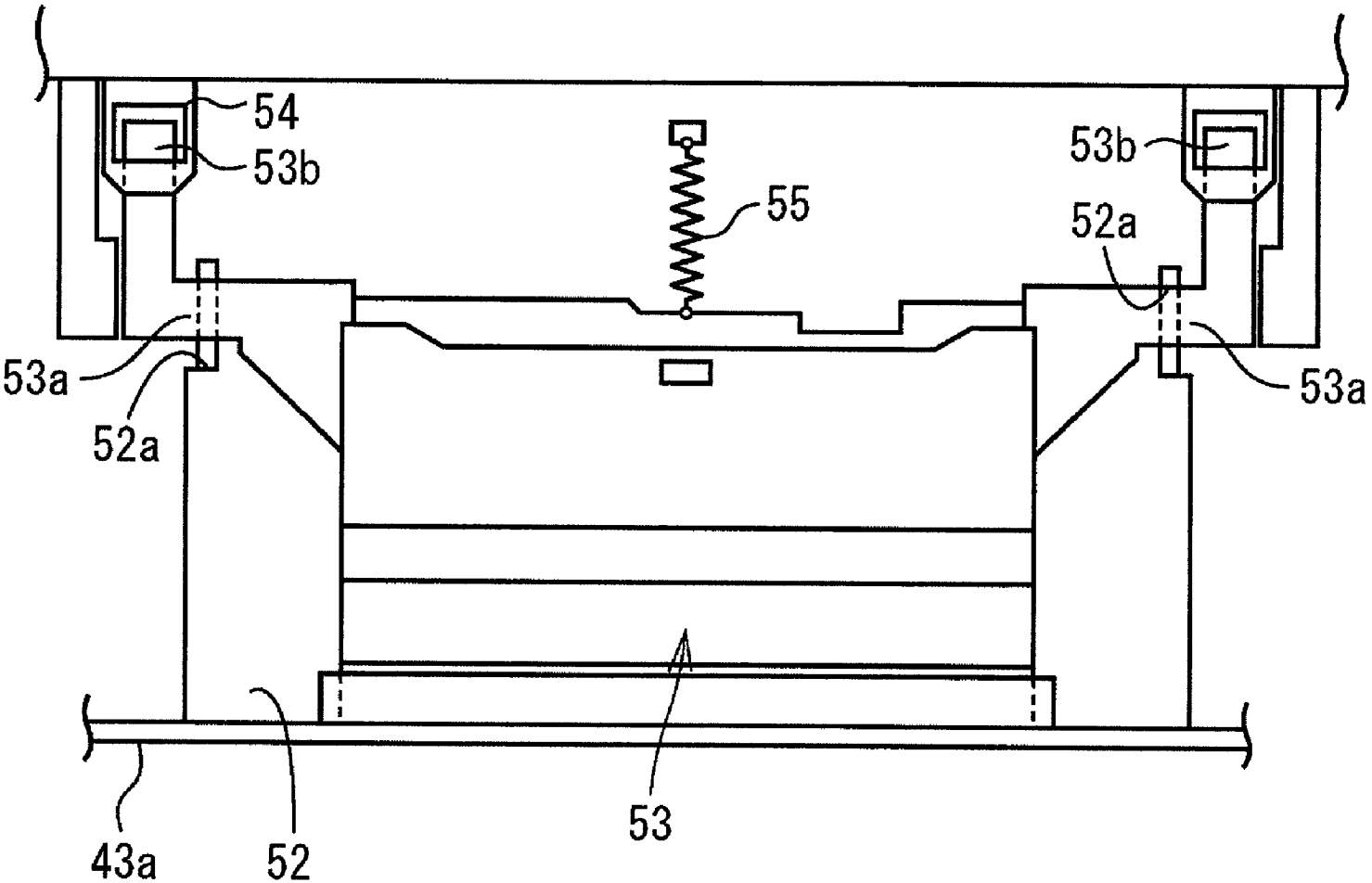
FIG. 8 is a plan view of a lock device of the third guide member in FIGS. 4A-B.

An upper middle portion of rear plate 43*a* with respect to Y direction may have a recess 52, as shown in FIG. 2. A grip portion 53 may be positioned in recess 52. Referring to FIG. 8, grip portion 53 may comprise a pair of hooks 53*b*. Hooks 53*b* may function as a lock device. Shaft 53*a* may extend laterally from grip portion 53. Each shaft 53*a* may be rotatably coupled to a bearing 52*a* adjacent to recess 52. Grip portion 53 may be coupled to a spring 55. Spring 55 may urge each hooks 53*b*, which may protrude upward, to engage respective engagement portions 54 formed in a frame of housing 2 from below. When third guide member 43 pivots in a direction to cover rear opening 35, hooks 53*b* may engage respective engagement portions 54 from below. Engagement between hooks 53*b* and engagement portions 54 may be maintained by spring 55.

Second guide member 42 may comprise a hook member 58. Hook member 58 may function as an engaging member. Hook member 58 may be at an engaged position in which hook member 58 is engaged with an engagement portion 63, e.g., a receiving portion, formed on third guide member 43, facing hook member 58 across lower sheet path 34. When sheet P1 passes through lower sheet path 34, a leading edge of sheet P1 may raise hook member 58 from the engaged position to a disengaged position, in which hook member 58 is disengaged from engagement portion 63, as shown in FIGS. 5A and 5B.

Figure 6:
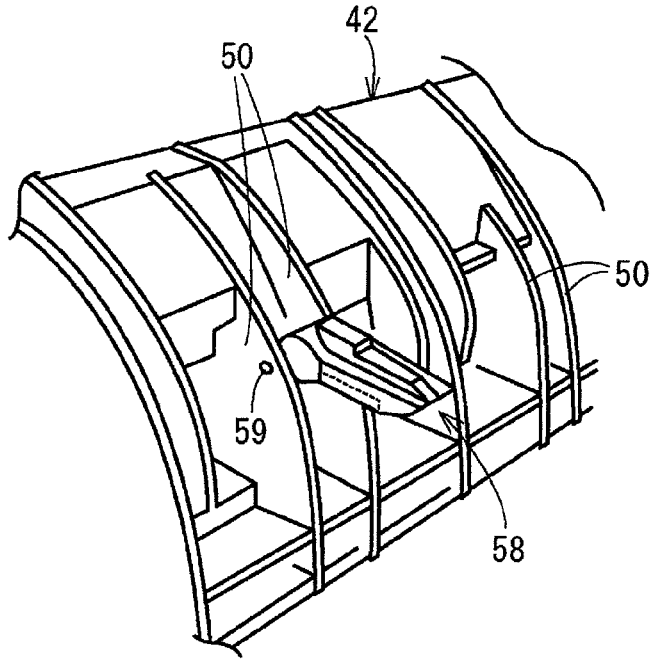
FIG. 6 is a perspective view of the hook member in FIGS. 5A-B.

Hook member 58 may be positioned at a middle portion second guide member 42 in a width, e.g., lateral, direction of sheet feeding path 34. Referring to FIG. 6, hook member 58 may be positioned between two adjacent ribs 50 positioned at a middle portion of the outer surface of second guide member 42, with respect to the width, e.g., lateral, direction of sheet feeding path 34. Hook member 58 may comprise a resin material to reduce a weight thereof. A shaft 59, e.g., a rotating shaft, may be positioned at a base end of hook member 58. Shaft 59 may be supported by the two adjacent ribs 50. A portion of a torsion spring 60, e.g., an urging member, may be wound around shaft 59. An end of torsion spring 60 may be attached to an upper surface of hook member 58. The other end of torsion spring 60 may be attached to a portion of an outer surface of second guide member 42. A hook 58*a* of hook member 58 may be urged downward to engage engagement portion 63, as shown in FIG. 5A.

Figure 7A:
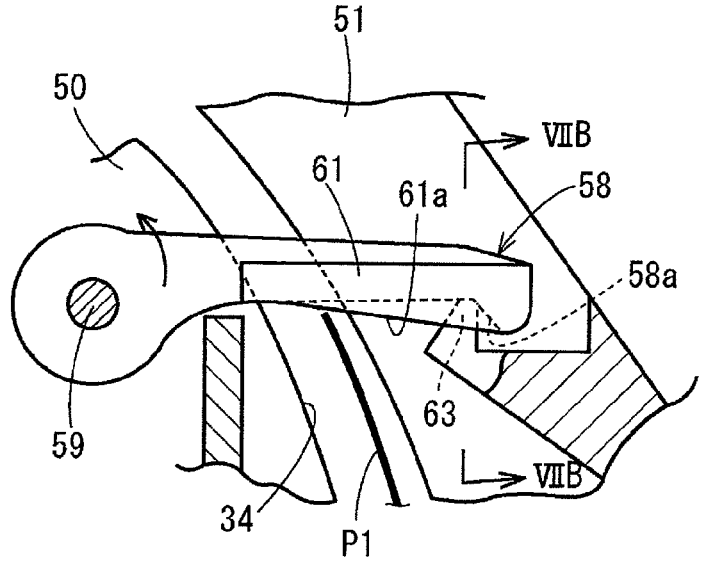
FIG. 7A is a partially enlarged cross-sectional view of the hook member in FIG. 6.
Figure 7B:
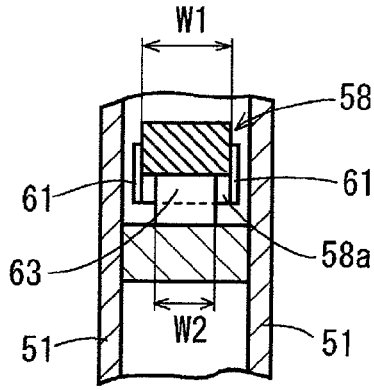
FIG. 7B is a cross-sectional view of the hook member taken along line VIIB-VIIB of FIG. 7A.

Referring to FIG. 7B, engagement portion 63 may be positioned between two adjacent ribs 51 formed on an inner surface of third guide member 43. A width W2 of engagement portion 63 in the width direction of sheet feeding path 34 may be smaller than a width W1 of hook 58*a* in the width direction of sheet feeding path 34.

An urging force of torsion spring 60 may be a small amount of force such that the leading end of sheet P1 passing through sheet path 34 may pivot hook member 58 to disengage hook 58*a* of hook member 58 from engagement portion 63. After the trailing end of sheet P1 passes through hook member 58, the urging force of torsion spring 60 may pivot hook member 58 downward to engage disengage hook 58*a* with engagement portion 63.

A resin plate 61 may be adhered to each of right and left side of hook member 58 by an adhesive agent to sandwich hook 58*a*. Resin plate 61 may have a surface with good slippage to sheets P1. Resin plate 61 may reduce sheet jams, which may occur when the leading end of sheet P1 is caught by hook 58*a* as hook member 58 is pivoted against the urging force of torsion spring 60 by the leading end of sheet P1 as sheep P1 passes through sheet path 34 from below. A lower end 61*a* of resin plate 61 may be positioned lower than a top portion of engagement portion 63. Resin plate 61 may be formed with a smooth surface to readily slide the leading end of sheet P1, which may slide from lower end 61*a* toward hook 58*a*.

When an image recording command including a sheet size designation is entered into MFD 1, one of upper and lower sheet cassette 20 and 30 holding sheets of the designated sheet size may be selected. When upper pickup roller 23 is driven in response to the sheet size designation, uppermost sheet P in upper sheet cassette 20 may be separated from sheet stack P with the aid of upper separation plate 21. The uppermost sheet P may be fed through upper sheet path 24 to recording unit 12, via registration rollers 27.

When lower pickup roller 33 is driven in response to the sheet size designation, uppermost sheet P1 in lower sheet cassette 30 may be separated from sheet stack P1 with the aid of lower separation plate 31. The uppermost sheet P1 may be fed through lower sheet path 34 to recording unit 12, via registration rollers 27.

When sheet jams occur in upper sheet path 24 in a state in which sheet P1 is not in lower sheet path 34, second and third guide members 42 and 43 may be coupled to each other by hook member 58. Grip portion 53 may be pivoted to disengage hooks 53*b* from engagement portions 54. Then, third guide member 43 may be pivoted in the clockwise direction, as shown in FIG. 3A. Second guide member 42 may also may pivot together with third guide member 43. As an angle of pivoting third guide member 43 increases, hook member 58 may disengage from engagement portion 63, because shaft 44 is positioned higher than shaft 45 and curvature radius of third guide member 43 is larger than that of second guide member 42. The center of gravity of second guide member 42 may be positioned outside shaft 44, such that second guide member 42 may pivot further. Third guide member 43 also may pivot further, as shown in FIG. 4A. Thus, rear opening 35 may be exposed by the operation of pivoting third guide member 43.

When sheet jams occur in upper sheet path 24 in a state in which sheet P is held between registration rollers 27, both guide members 42 and 43 may open at a time to readily clear the sheet jams.

When sheet jams occur in lower sheet path 34 at a position where the leading end of sheet P1 moved past hook member 58, hook member 58 may be maintained in the disengaged position by a portion of sheet P1, as shown in FIGS. 3B and 5B. In this state, hooks 53*b* may disengage from engagement portions 54 and when grip portion 53 is pivoted, second guide member 42 may remain in a closed position and only third guide member 43 may be pivoted open, as shown in FIG. 4B. Thus, the sheet jams in lower sheet path 34 may be readily cleared. Even when sheet jams occurs in lower sheet path 34 in a state in which the leading end of sheet P1 is held between registration rollers 27 and the trailing end of sheet P1 is pressed against lower pickup roller 33, sheet P1 may not be damaged because only third guide member 43 positioned at outer side of lower sheet path 34 may be pivoted open.

Both second and third guide members 42 and 43 may be pivoted to a closed position by one closing operation of third guide member 43. Referring to FIGS. 9A-9E, when third guide member 43 is pivoted inwardly in a clockwise direction in FIGS. 9A-9E, e.g., when member 43 covers rear opening 35, a pair of slidable guide portions 65 of second guide member 42 may contact a pair of respective guiding portions 67 of third guide member 43 to pivot second guide member 42 inwardly.

Slidable guide portions 65 may be positioned on an outer surface of second guide member 42. Specifically, slidable guide portions 65 may be formed on an outer edge portion of respective plates 66. Plate 66 may be positioned at left and right ends of second guide member 42 in a width direction of second guide member 42. Plate 66 may be positioned further away from the center of second guide member 42 in the width direction than a portion of ribs 50, which is configured to contact sheet P1.

Guiding portions 67 may be positioned on an inner surface of third guide member 43. Specifically, guiding portions 67 may be formed on an inner edge portion of respective plates 68 to face the respective slidable guide portions 65. Plate 68 may be positioned at left and right ends of third guide member 43 in a width direction of third guide member 43. Guiding portion 67 may be positioned further away from the center of third guide member 43 in the width direction of third guide member 43 than outside ribs 51 and closer to the center of third guide member 43 in the width direction of third guide member 43 than respective fin portions 43*b*.

Shaft 44 of second guide member 42 may be positioned higher than shaft 45 of third guide member 43 with respect to the bottom of MFD 1. Therefore, when third guide member 43 pivots about shaft 45 from an open position to a closed position, as shown in FIGS. 9A-9F, slidable guide portion 65 may slide up against guiding portions 67 toward the free end of third guide member 43. Second and third guide members 42 and 43 may simultaneously pivot close when second guide member 42 is pivoted by guiding portions 67 formed on an inner side of third guide member 43.

Referring to FIG. 8, Third guide member 43 may comprise hooks 53*b*, which may function as a lock device, configured to hold third guide member 43 in a closed position to cover rear opening 35. Therefore, even when sheet P1 passing through lower sheet path 34 pushes on third guide member 43, third guide member 43 may not rattle.

Front opening 14, from which sheet cassettes 20 and 30 may be inserted into housing 2, may be formed on a face of housing 2 opposite to rear opening 35. Rear opening 35 may be covered by second and third guide members 42 and 43. When sheet cassettes 20 and 30 are drawn from front opening 14 at the time of sheet jams, likelihood of sheet P and P1 being damaged may be reduced.

In another embodiment, third guide member 43 may comprise hook member 58, which may function as an engagement device. Second guide member 42 may comprise engagement portion 63. A leading end of sheet P1 passing through lower sheet path 43 from below may pivot hook member 58 against an urging force of torsion spring 60 to disengage hook member 58 from engagement portion 63. Grip portion 53 may be pivoted to disengage hooks 53*b* from engagement portions 54. When hook member 58 engages engagement portion 63, second and third guide members 42 and 43 may be pivoted from a closed position to an open position by pivoting third guide member 43 in the clockwise direction in FIG. 3A.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A sheet feeding device comprising:

an inner guide member comprising an inner guide portion;

an outer guide member comprising an outer guide portion, wherein the outer guide portion and the inner guide portion define a sheet feeding path therebetween, and the sheet feeding path is configured to receive a sheet;

an engaging member positioned adjacent to one of the inner guide member and the outer guide member; and a receiving portion positioned at the other one of the inner guide member and the outer guide member and positioned to face the engaging member, wherein the receiving portion is configured to selectively engage the engaging member;

wherein the engaging member is configured to move between an engaged position in which the engaging member is engaged with the receiving portion and a disengaged position in which the engaging member is disengaged from the receiving portion, and when the engaging member is at the engaged position, the inner guide member is connected to the outer guide member via the engaging member and the receiving portion, and wherein when the engaging member contacts the sheet in the sheet feeding path, the engaging member is in the disengaged position, and when the engaging member is separated from the sheet in the sheet feeding path, the engaging member is in the engaged position.

2. The sheet feeding device of claim 1, wherein the engaging member moves from the engaged position to the disengaged position when a leading end of the sheet fed in the sheet feeding path contacts the engaging member and moves in a sheet feeding direction; and wherein the engaging member moves from the disengaged position to the engaged position when a trailing end of the sheet fed in the sheet feeding path separates from the engaging member and moves in the sheet feeding direction.

3. The sheet feeding device of claim 1, wherein at least a portion of the engaging member is positioned in the sheet feeding path when the engaging member is in the engaged position, and when the sheet contacts the engaging member, the engaging member pivots from the engaged position to the disengaged position.

4. The sheet feeding device of claim 1, wherein the engaging member pivots about a rotating shaft when the engaging member selectively moves between the engaged position and the disengaged position.

5. The sheet feeding device of claim 1, further comprising an urging member configured to urge the engaging member toward the engaged position.

6. The sheet feeding device of claim 1, wherein the engaging member is positioned substantially at a central portion of the sheet feeding path in a width direction.

7. The sheet feeding device of claim 1, wherein a width of the engaging member in a width direction of the sheet feeding path is larger than a width of the receiving portion in the width direction of the sheet feeding path.

8. The sheet feeding device of claim 1, wherein when the engaging member is at the engaged position and the outer guide member rotates from a first closed position to a first open position, the inner guide member rotates from a second closed position to a second open position.

9. The sheet feeding device of claim 8, wherein when the outer guide member rotates for greater than a predetermined amount of rotation, the engaging member disengages from the receiving portion.

10. The sheet feeding device of claim 1, wherein when the engaging member is at the disengaged position and the outer guide member rotates from a closed position to an open position, the inner guide member maintains its position and the outer guide member rotates to expose the sheet feeding path.

11. An image recording apparatus comprising:

a sheet feeding device comprising:

an inner guide member comprising a particular inner guide portion;

an outer guide member comprising an outer guide portion, wherein the outer guide portion and the particular inner guide portion define a particular sheet feeding path therebetween, the particular sheet feeding path is configured to receive a sheet;

an engaging member positioned adjacent to one of the inner guide member and the outer guide member; and a receiving portion positioned at the other one of the inner guide member and the outer guide member and positioned to face the engaging member, wherein the receiving portion is configured to selectively engage the engaging member;

a particular sheet stack portion configured to receive the sheet; and a recording unit configured to record an image on the sheet, wherein the engaging member is configured to move between an engaged position in which the engaging member is engaged with the receiving portion and a disengaged position in which the engaging member is disengaged from the receiving portion, and when the engaging member is at the engaged position, the inner guide member is connected to the outer guide member via the engaging member and the receiving portion, and wherein when the engaging member contacts the sheet in the particular sheet feeding path, the engaging member is in the disengaged position, and when the engaging member is separated from the sheet in the particular sheet feeding path, the engaging member is in the engaged position.

12. The image recording apparatus of claim 11, the inner guide member further comprising a further inner guide portion, wherein the further inner guide portion defines a portion of a further sheet feeding path, wherein the image recording apparatus further comprises a further sheet stack portion configured to receive a sheet fed in the further sheet feeding path.

13. The image recording apparatus of claim 11, wherein each of the particular sheet feeding path and the further sheet feeding path is formed in a U shape.

14. The image recording apparatus of claim 11, wherein when the engaging member is at the engaged position and the outer guide member rotates from a first closed position to a first open position, the inner guide member rotates from a second closed position to a second open position.

15. The image recording apparatus of claim 14, wherein when the outer guide member rotates from the first open position to the first closed position, the inner guide member rotates from the second open position to the second closed position.

* * * * *